US008020419B2

(12) United States Patent
Ghiran et al.

(10) Patent No.: US 8,020,419 B2
(45) Date of Patent: Sep. 20, 2011

(54) HYDROFORMING DIE ADJUSTABLE FOR SPRINGBACK CORRECTION

(75) Inventors: Mike M. Ghiran, Lake Orion, MI (US); Wei Ji, Troy, MI (US); Mark P. Donoghue, Clarkston, MI (US); Terry A. Kent, East China, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 827 days.

(21) Appl. No.: 12/102,968

(22) Filed: Apr. 15, 2008

(65) Prior Publication Data

US 2009/0255308 A1 Oct. 15, 2009

(51) Int. Cl.
*B21D 26/02* (2011.01)
*B21C 1/00* (2006.01)

(52) U.S. Cl. ..... 72/61; 72/702

(58) Field of Classification Search ..... 72/58, 61, 72/62, 370.22, 702, 149–151, 387
See application file for complete search history.

(56) References Cited

U.S. PATENT DOCUMENTS 5,353,622 A * 10/1994 Theener ..... 72/387
7,204,114 B2 * 4/2007 Ni et al. ..... 72/61
7,587,920 B2 * 9/2009 Kim ..... 72/58

* cited by examiner

*Primary Examiner* — Edward Tolan
*Assistant Examiner* — Mohammad I Yusuf

(57) ABSTRACT

The invention provides a hydroforming apparatus for forming a length of tube. A hydroforming press includes an upper platen and a lower plate. A first die set is provided for forming a first lengthwise portion of the tube and a second die set provided adjacent the first die set which forms a second lengthwise portion of the tube. A first pivot acts between a first and second upper die so that the second upper die can be pivotally adjusted on the upper platen relative to the first upper die. A second pivot acts between a first and second lower die so that the second lower die can be pivotally adjusted on the lower platen relative to the first lower die. A die insert is provided having an upper die insert and a lower die insert that define upper and lower insert cavities that connect together the first and second cavity portions of the upper die set and the lower die set. This die insert is removably mounted as needed to accommodate the pivotal adjustment between the first and second die sets.

15 Claims, 7 Drawing Sheets

HYDROFORMING DIE ADJUSTABLE FOR SPRINGBACK CORRECTION

FIELD OF THE INVENTION

The present invention relates to apparatus for hydroforming a tube and more particularly provides an adjustable die arrangement by which during die tryout, the die can be readily modified to compensate for part spring back.

BACKGROUND OF THE INVENTION

It is well known in the automotive and other manufacturing industries that a length of tube can be formed to provide various cross sections and bulges along its length by placing the tube in a die set and then introducing high pressure fluid into the tube to expand the tube walls outwardly into the die cavity.

In hydroforming, as in other metal forming operations, such as stamping, it is known that residual forces will reside in the formed part and cause the formed part to spring back toward its unformed condition. Accordingly, it is well known in the design of hydroforming dies to attempt to predict the degree of springback during the die design process so that the part can be formed in a way that upon removal from the die, and the occurrence of the inevitable springback, the part will spring back to the precise finished shape that is desired.

To the extent that springback cannot be fully predicted during the design of the part and the die, it is well known that the dies must be adjusted by trimming or re-machining to relocate the die cavity so that the formed part will spring back to the desired dimension. This die operation, with the attendant trimming and re-machining of the die cavities, adds time and expense to the implementation of manufacturing processes.

The occurrence of springback is especially prevalent and difficult to predict when high strength tubular materials are to be formed.

Depending upon the complexity of the tube shape to be formed, it is often the practice to employ a tube bending operation to bend the tube about its longitudinal axis, for example, to an L-shape, so that the tube will fit into the die cavity. After the tube has gone through a tube-bending operation, certain residual forces will reside in the bent tube and these forces will become unleashed during the pressure forming in the hydroform die, further complicating the prediction of part springback and thereby further causing the need for die cavity trimming and re-machining.

In view of the foregoing, it would be highly desirable to provide a new and improved hydroforming apparatus which would minimize the time and expense of re-machining hydroforming die cavities during die tryout.

SUMMARY OF THE INVENTION

The invention provides a hydroforming apparatus for forming a length of tube. A hydroforming press includes an upper platen and a lower platen. A first die set for forming a first lengthwise portion of the tube includes a first upper die attached to the upper platen and a first lower die attached to the lower platen. The first die set defines a cavity portion for receiving the first lengthwise portion of the tube. A second die set is provided adjacent the first die set and forms a second lengthwise portion of the tube. The second die set includes a second upper die adjustably attached to the upper platen, and a second lower die adjustably attached to the lower platen. The second die set defines a second cavity portion for receiving the second lengthwise portion of the tube. A first pivot acts between the first upper die and the second upper die so that the second upper die can be pivotally adjusted on the upper platen relative to the first upper die. A second pivot acts between the first lower die and the second lower die so that the second lower die can be pivotally adjusted on the lower platen relative to the first lower die. A die insert is provided having an upper die insert and a lower die insert that define upper and lower insert cavities that connect together the first and second cavity portions of the upper die set and the lower die set. This die insert is removably mounted so as to be readily replaced with a replacement die insert as needed to accommodate the pivotal adjustment between the first die set and the second die set.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings.

DETAILED DESCRIPTION OF THE EXEMPLARY EMBODIMENTS

The following description is merely exemplary in nature and is not intended to limit the invention, its application, or uses.

Figure 1:
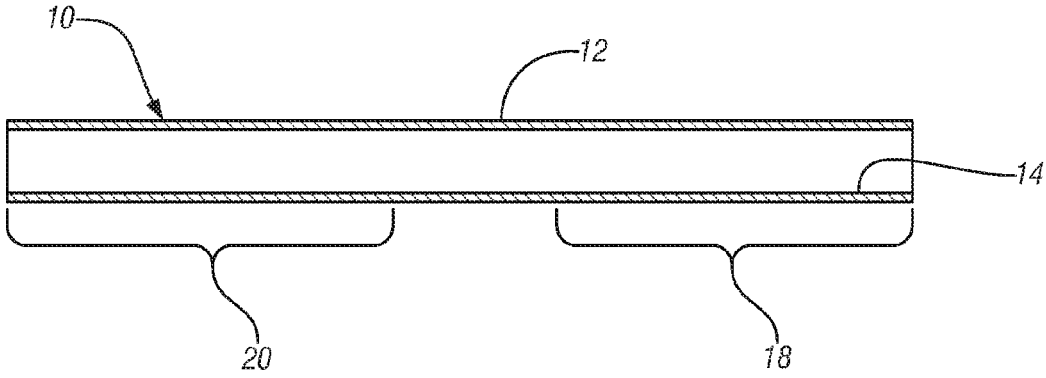
FIG. 1 is a section view of a length of tube.

Referring to FIG. 1, a length of hollow tube 10 is shown and has an outer surface 12 and an inner surface 14. The tube 10 is of a chosen length and has a first lengthwise portion 18 and a second lengthwise portion 20.

Figure 2:
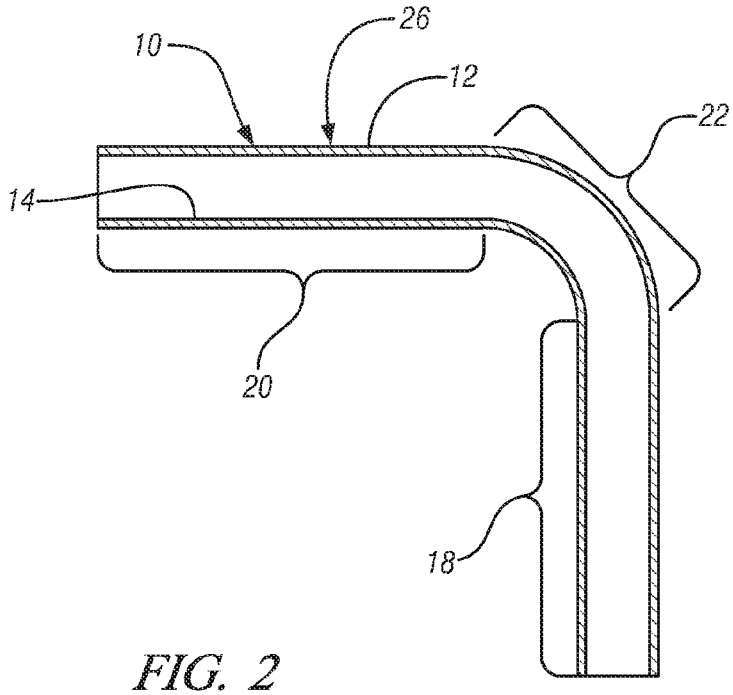
FIG. 2 shows the length of tube of FIG. 1 bent into an L-shape.

Referring to FIG. 2, it is seen that the tube 10 of FIG. 1 has been bent into an L-shape in a conventional tube-bending operation so that the first lengthwise portion 18 and second lengthwise portion 20 are now disposed at 90 degrees to one another and connected at a 90-degree corner portion 22. The tube 10 of FIG. 2 has thus been pre-bent to a shape to define a tubular blank 26 that will subsequently be placed into a hydroforming die.

Figure 3:
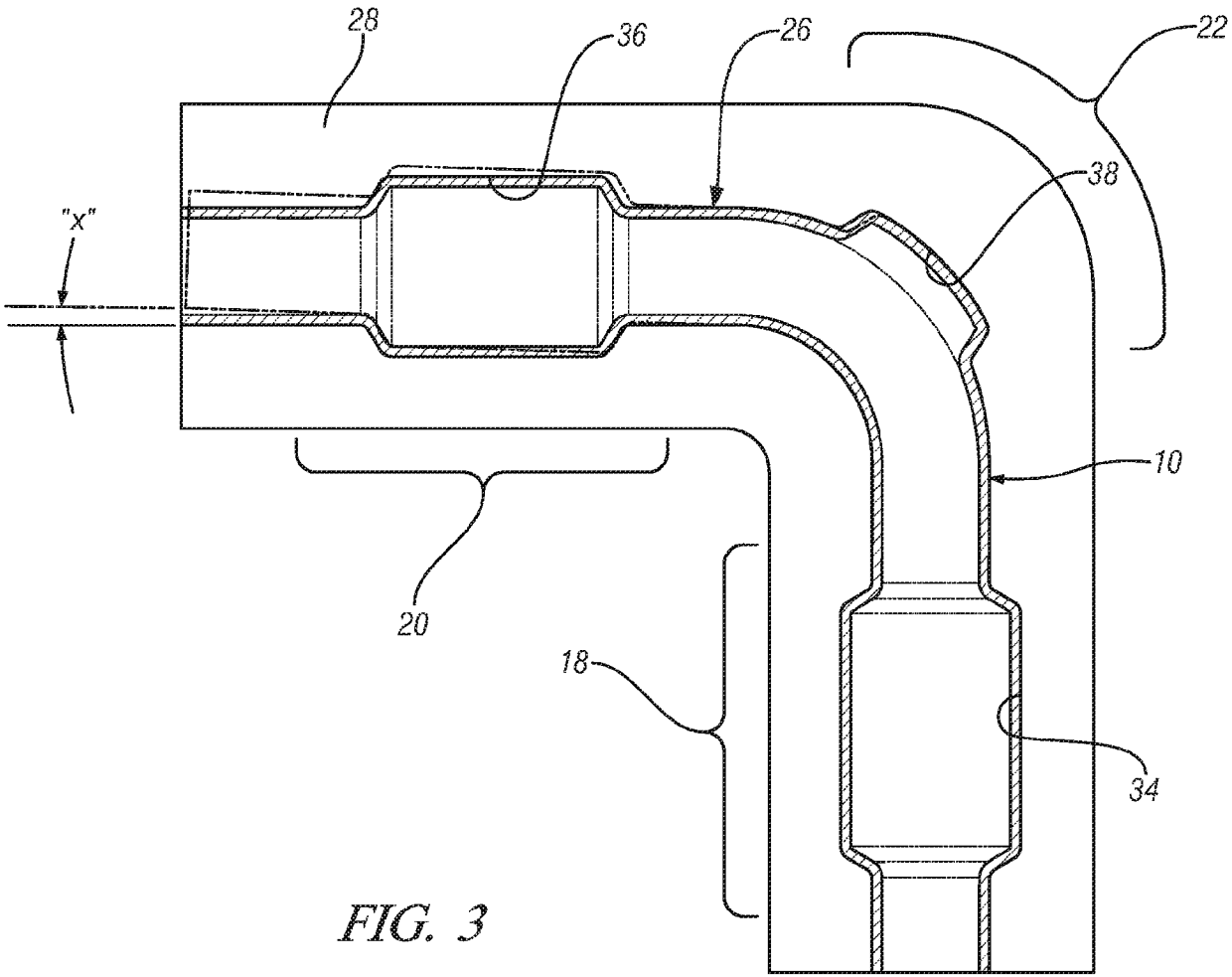
FIG. 3 shows the L-shape tube of FIG. 2 having been hydroformed along its length to varying cross sections.

FIG. 3 shows the tubular blank 26 of FIG. 2 situated in a lower hydroforming die 28, it being understood that a mating upper die would be placed atop the lower die 28 to contain and surround the tube 10. Subsequently, as well known in the hydroforming process, seal units, not shown in FIG. 3, will be attached to the open ends of the tube 10. Then pressurized fluid is introduced into the interior of the tube 10 to expand the tube 10 outwardly into expansion cavities as shown at a tube expansion cavity 34 in the first lengthwise portion 18, a tube expansion cavity 36 at the second lengthwise portion 20, and an expansion cavity 38 at the corner portion 22 of the tubular blank 26.

After the tube 10 has been expanded into the desired shape defined by the cavity portions 34, 36, and 38, the upper die will be lifted and then the finished part 10 is removed from the lower die 28. It is characteristic of hydroforming and other metal forming portions that residual forces will reside in the formed article, causing the article to spring back somewhat toward its prior shape, so that the finished part may be out of tolerance with respect to the product design requirements. For example, in FIG. 3, the spring back of several degrees is shown at "x".

Accordingly, it is well known in the industry that the die set would then be re-machined or replaced in its entirety to modify the shape of the die cavities in a way that the next tryout will have the part spring back to the dimensions that are within the tolerance requirements for the finished part. For example in FIG. 3, the second lengthwise portion 20 and the corner portion 22 would be re-machined in relation to the first lengthwise portion 18.

FIGS. 4-9 show a new and improved adjustable hydroforming die assembly for hydroforming the tubular blank 26 of FIG. 2.

Figure 4:
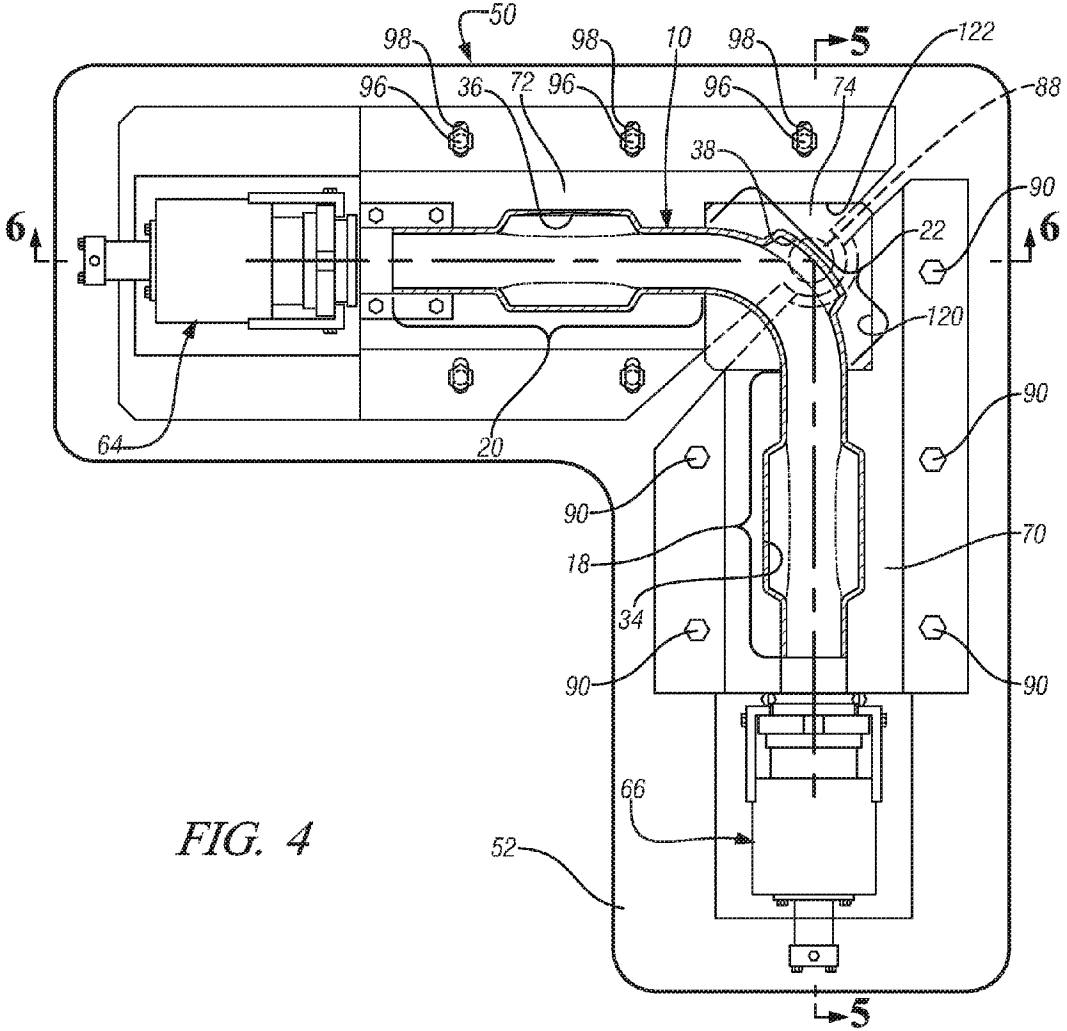
FIG. 4 is a plan view showing the lower platen of a press and a lower die set mounted on the platen, and end seals for sealing the ends of the tube.

Referring to FIG. 4, a hydroforming press generally indicated at 50 includes a fixed lower platen 52. Hydroforming seal units, generally indicated at 64 and 66, are mounted on the lower platen 52, as will be discussed hereinafter.

As seen in FIG. 4, a lower die assembly includes a first lower die 70, a second lower die 72, and a lower die insert 74. The first lower die 70 receives the first lengthwise portion 18 of the tubular blank 26, the second lower die 72 receives the second lengthwise portion 20 of the tubular blank 26, and the lower die insert 74 that receives the corner portion 22 of the tubular blank 26.

Figure 5:
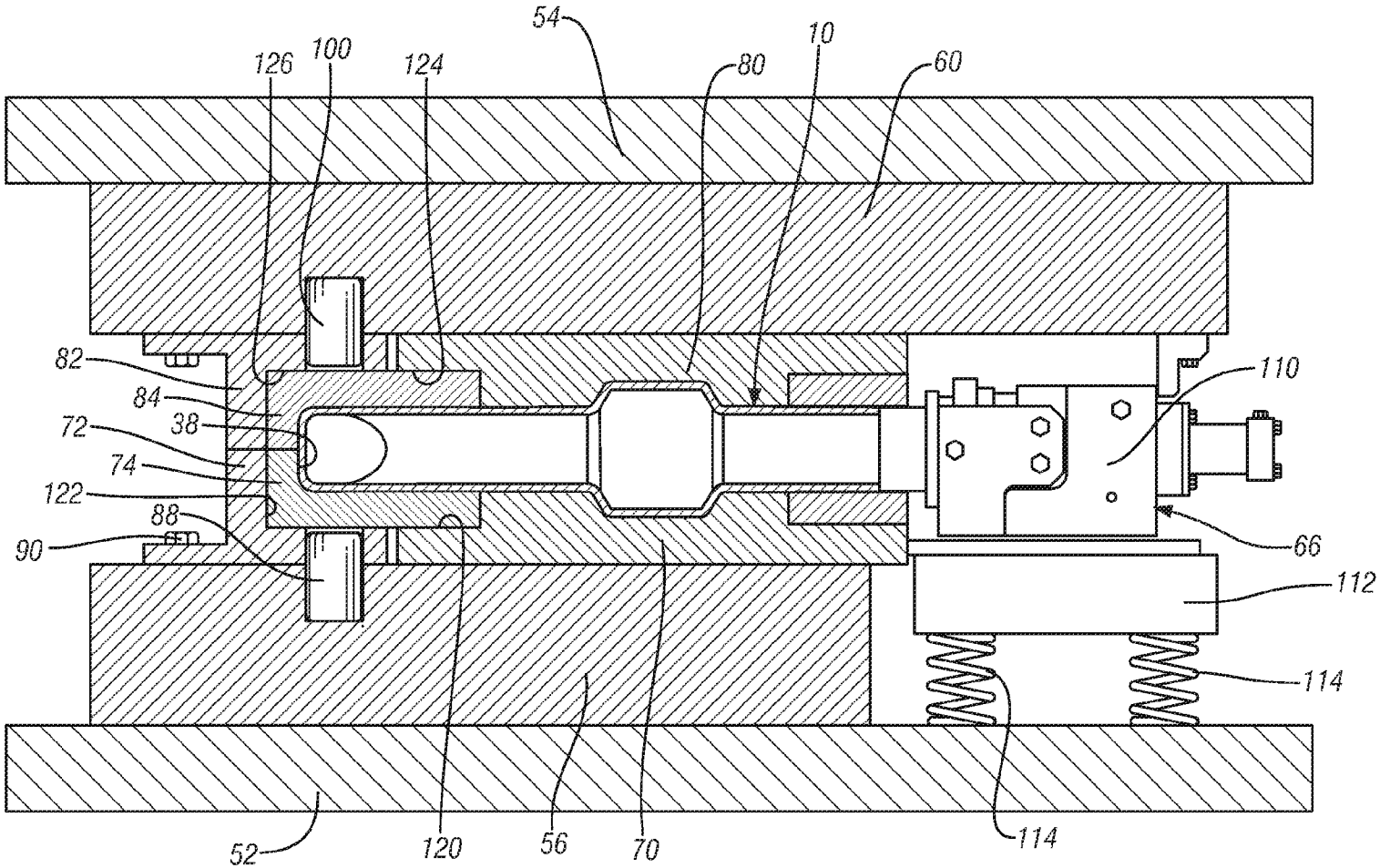
FIG. 5 is a side elevation view taken in the direction of arrows 5-5 of FIG. 4, and having parts broken away and in section.
Figure 6:
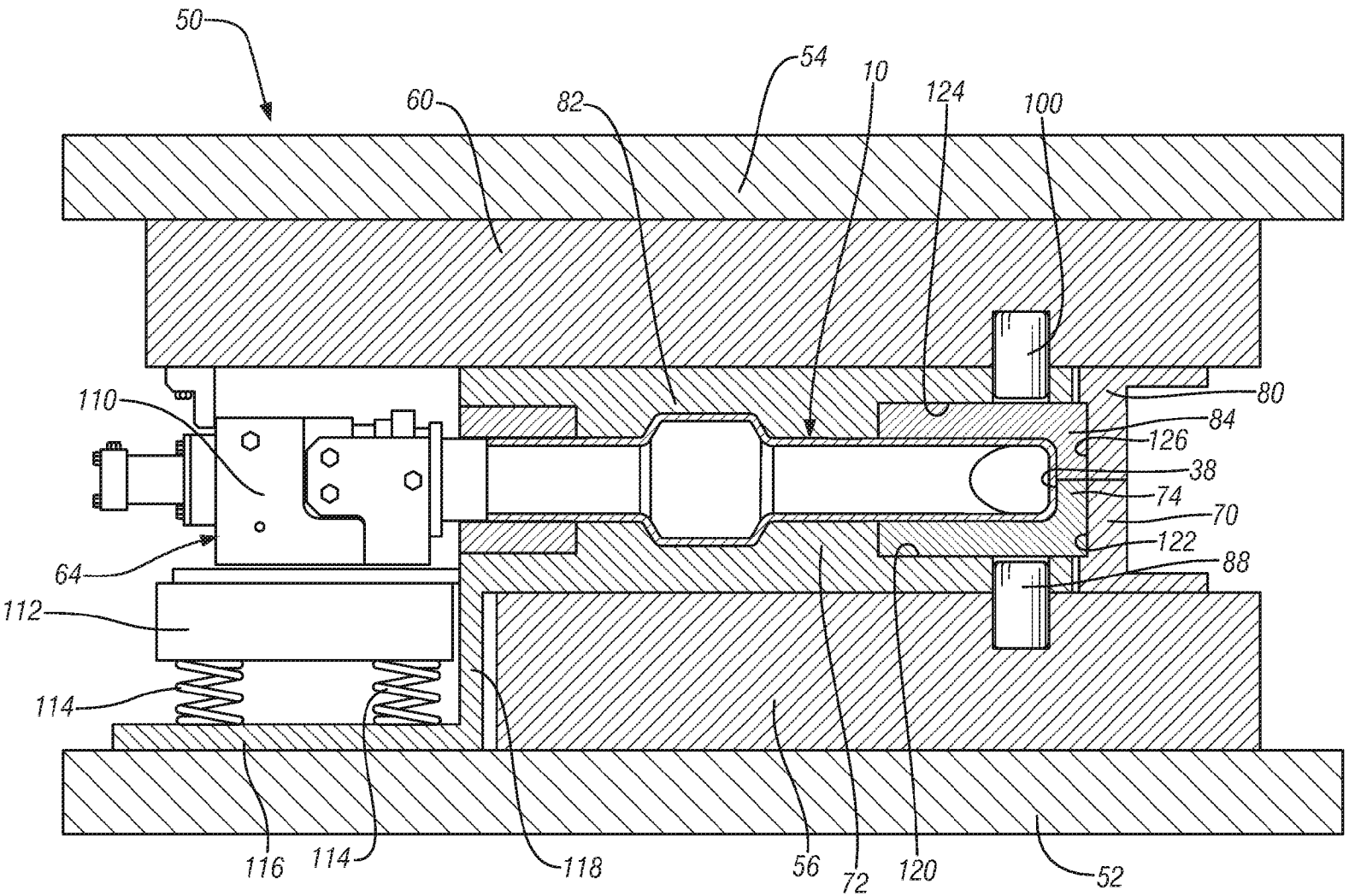
FIG. 6 is a side elevation view taken in the direction of arrows 6-6 of FIG. 4, and having parts broken away and in section.
Figure 8:
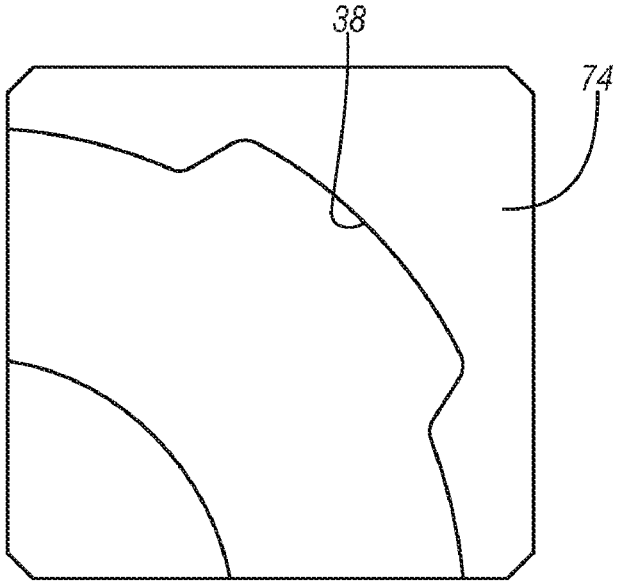
FIGS. 8 and 9 are plan views of the die inserts that were removed from FIG. 7.
Figure 9:
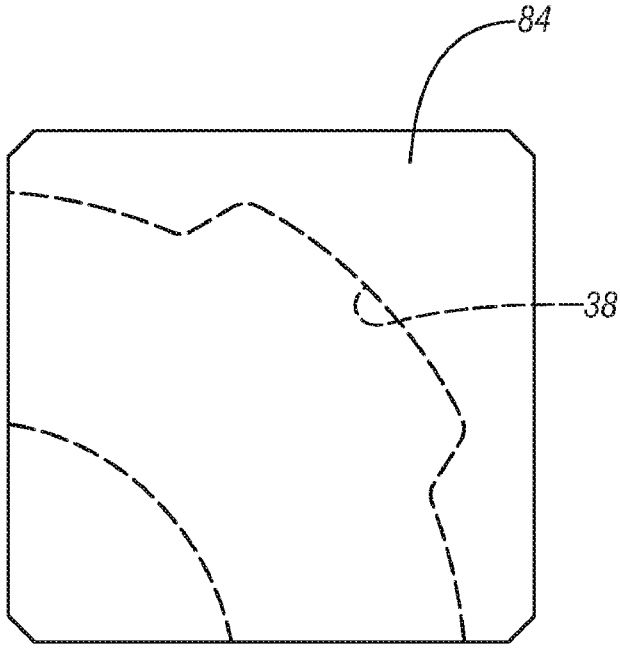

Referring to FIGS. 5 and 6, it is seen that the hydroforming press 50 has an upper platen 54 that carries an upper die base 60. The press 50 will open and close by raising and lowering the upper platen 54 relative to the lower platen 52 and a lower die base 56 that is mounted on the lower platen 52. In FIG. 5, a first upper die 80 opens and closes vertically relative to the first lower die 70. In FIG. 6, a second upper die 82 will open and close over the second lower die 72. FIGS. 5 and 6 show an upper die insert 84 that opens and closes over the lower die insert 74. The lower die insert 74 is shown in FIG. 8. The upper die insert is shown in FIG. 9.

Accordingly, it is seen that first upper die 80 and the first lower die 70 cooperate to provide a first die set having a cavity for forming the first lengthwise portion 18 of the tubular blank 26. The second upper die 82 and the second lower die 72 cooperate to provide a second die set having a cavity for forming the second lengthwise portion 20 of the tubular blank 26. And the upper die insert 84 and the lower die insert 74 cooperate to provide a die insert having a cavity for forming the corner portion of the tubular blank 26.

Referring again to FIG. 4, it is seen that the first lower die 70 is fixedly attached to the lower die base 56 by a plurality of bolts 90. As best seen in FIGS. 4, 5 and 6, a pivot pin 88 pivotally connects together the adjacent ends of the first lower die 70 and second lower die 72 in the region of the corner portion 22. The second lower die 72 is adjustably attached to the lower die base 56 by a plurality of bolts 96 that are threaded into the die base 56, but ride in slotted bolt holes 98 of the second lower die 72. Accordingly, by virtue of the pivot pin 88, and the slotted bolt holes 98, it will be understood that the second lower die 72 can be pivoted about the pivot pin 88 relative to the fixed position of the first lower die 70. FIGS. 4, 5 and 6 also show that the first upper die 80 and the second upper die 82 are likewise connected by a pivot bolt 100. In addition, the second upper die 82 is adjustably attached to the upper die base 60 by bolts, not shown, that ride in slotted bolt holes similar to the slotted bolt holes 98 of the second lower die 72. Accordingly, the second upper die 82 can be adjusted about its pivot 100 as needed to maintain the second upper die 82 in exact alignment with the second lower die 72

Referring again to FIG. 5, it is seen that the seal unit 66 is a conventional hydroforming end seal unit including a seal housing 110 that is mounted on a bed 112 that is supported on the lower platen 52 by a plurality of nitrogen die springs 114. Referring again to FIG. 6, it is seen that the seal unit 64 is a conventional hydroforming end seal unit including a seal housing 110 that is mounted on a bed 112 that is supported by a plurality of nitrogen die springs 114. The die springs 114 rest on a platform 116 that is connected to the lower die 72 by a leg 118. Accordingly, when the first lower die 72 is pivotally adjusted and swings about the pivot pin 88, the seal unit 64 will follow along so that the seal unit 64 will be maintained in precise alignment with the end of the tube 10.

Referring now to FIGS. 5 and 6, it is seen that the lower die insert 74 is seated within an insert pocket 120 in the first lower die 70 and an insert pocket 122 provided in the adjacent end of the second lower die 72. The lower die insert 74 is held in place by a plurality of removable bolts, not shown, so that the lower die insert 74 can be readily mounted and unmounted from the dies 70 and 72. In FIGS. 5 and 6 it is seen that the upper die insert 84 is likewise mounted in insert pocket 124 in the first upper die 80 and insert pocket 126 in the second upper die 82.

Figure 7:
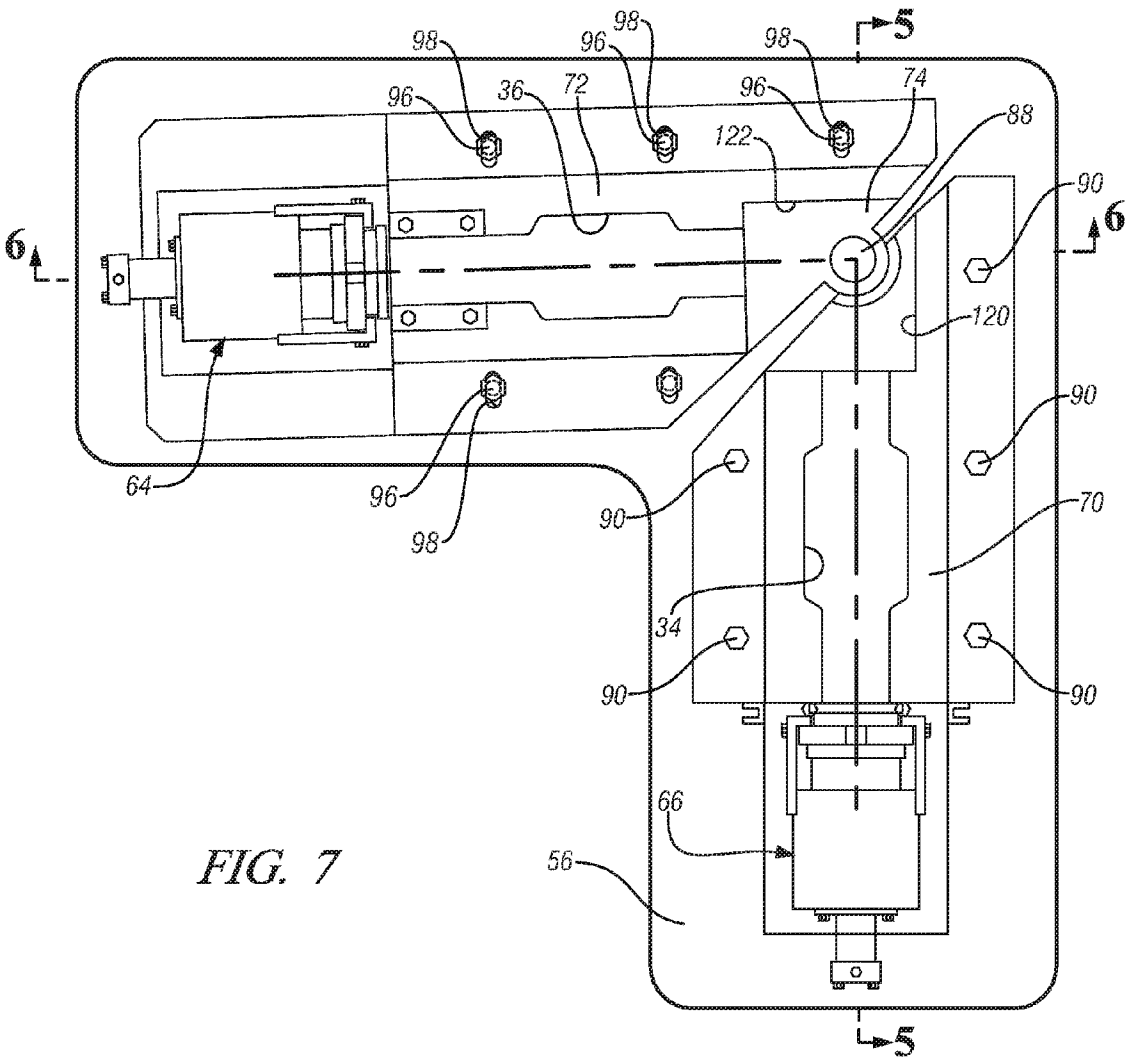
FIG. 7 is a view similar to FIG. 4, however the die inserts have been removed.

FIG. 7 shows that the lower die insert 74 has been removed from the insert pockets 120 and 122.

Operation

FIG. 4 shows that the first lower die 70 and second lower die 72 are positioned relative one another with the second lower die 72 at a 90-degree angle with respect to the first lower die 70. The second upper die 82 is of course adjusted to the same 90-degree angle so that it will close precisely over the second lower die 72. The tubular blank 26 of FIG. 2 is positioned into the cavities defined by the lower dies 70 and 72 and lower die insert 84. The seal units 64 and 66 are advanced to seal onto the ends of the tubular blank 26. The upper platen 54 will be lowered to close the first upper die 80 and second upper die 82 onto the first lower die 70 and second lower die 72. Thereafter, pressurized fluid is introduced into the tubular blank 26 through at least one of the seal units 64 and 66 to expand the tube outwardly into the various cavities 36, 38 and 34. After the tubular blank 26 is fully expanded, the upper platen 54 is raised to lift the upper dies 80 and 82, the seal units 64 and 66 are withdrawn from the tube ends, and thereafter the formed finished tubular part is removed from the hydroforming press. The finished part is then measured to determine whether its formed shape is within the required tolerances. As often happens, the finished part will spring back toward its unformed condition upon removal from the dies and, it would be necessary in traditional hydroforming dies to trim or re-machine the dies to obtain the required tolerances.

The present invention facilitates the adjustment and re-machining of the dies by enabling the adjustment and minimizing the need for re-machining. In particular, the lower die insert 74, FIG. 9, will be unbolted from the lower dies and the upper die insert 84 will likewise be unbolted from the upper dies. Thereafter, the bolts 96 holding the second lower die 72 will be loosened and the second lower die 72 pivoted about the pivot pin 88 to a new position that is estimated to compensate for the degree of springback that had been experienced. For example, the second lower die 72 might be pivoted from an angle of 90 degrees from the first lower die 70 to a new position of 92 degrees relative to the first lower die 70. A new lower die insert 74 and a new upper die insert 84 are machined in a new shape that will provide a continuity of the cavity shape between the lower dies 70 and 72 and the upper dies 80 and 82. The new die inserts 74 and 84 are bolted in place. Thereafter, a new trial part can be hydroformed and this new trial part will once again be measured for compliance to the dimensional requirements for a proper finished part.

The foregoing die tryout process will be repeated until a successful properly dimensioned part is achieved. That is, continuing angular adjustments of the second lower die 72 and its mating second upper die 82 can be made, and the lower die insert 74 and upper die insert 84 will be repeatedly re-machined and replaced until the properly dimensioned part is reliably obtained.

It will be understood that the adjustable die arrangement disclosed herein can be used for the ongoing production of a high quantity of parts. Alternatively, once the desired angular relationship between the dies is obtained via the tryout process herein, a more conventional set of dies could be machined using the final angle of adjustment learned in the foregoing method.

In view of the foregoing, it is seen that substantial economies of time and money can be accomplished by using the aforedescribed adjustable die arrangement. In particular, it will be understood that, in the prior art, as shown in the conventional die of FIG. 3, it would have been necessary to re-machine the entire die cavity of the die 28 in order to move the axis of the die cavity 36 by the number of degrees that the invention herein provides merely by adjusting the angle of the die 72 and then installing newly machined corner inserts 74 and 84.

It will be understood by a person of ordinary skill in the art that the foregoing description is merely exemplary of the use of an adjustable die arrangement. For example, the drawings and description herein describe a simple L-shaped part where the springback has occurred in a single plane so that two-dimensional pivoting of the final lower die 72 will accomplish the compensation required to accommodate the springback. However, it will be understood that the invention can be employed with more complexly-shaped parts where springback may occur in three dimensions. Accordingly, in the case of three-dimensional springback, the simple pivot point provided herein by the pivot bolts 88 and 100 would be replaced by a more complex ball joint pivoting mechanism which would enable the three-dimensional adjustment of the second upper and lower dies relative to the first upper and lower dies.

Although the tubular part being hydroformed in the example shown in the drawings is a generally L-shaped part, it will be understood that the apparatus of the invention may be employed in any shape of tubular part where spring back of the hydroformed tube will necessitate the trimming or re-machining of the die surfaces to obtain the needed final part.

What is claimed is:

1. A hydroforming apparatus for forming a length of tube, comprising:

a press having an upper platen and lower platen;

a first die set for forming a first lengthwise portion of the tube and including a first upper die attached to the upper platen and a first lower die attached to the lower platen, said first die set defining a first cavity portion for receiving the first lengthwise portion of the tube;

a second die set for forming a second lengthwise portion of the tube and including a second upper die adjustably attached to the upper platen and a second lower die adjustably attached to the lower platen, said second die set defining a second cavity portion for receiving the second lengthwise portion of the tube;

a first pivot acting between the first upper die and the second upper die so that the second upper die can be pivotally adjusted on the upper platen relative to the first upper die;

a second pivot acting between the first lower die and the second lower die so that the second lower die can be pivotally adjusted on the lower platen relative to the first lower die;

and a die insert having an upper die insert and a lower die insert defining relatively upper and lower insert cavities that connect together the first and second cavity portions of the upper die set and the lower set, said die insert being removable and replaceable with an alternative die insert as needed to accommodate the pivotal adjustment between the first die set and the second die set.

2. The hydroforming apparatus of claim 1 further comprising said first and second upper dies each having an insert receiving pocket adjacent to the first pivot and having the upper die insert removably mounted therein; and the first and second lower dies each having an insert receiving pocket adjacent the second pivot and having the lower insert of the die insert removably mounted therein.

3. The hydroforming apparatus of claim 1 further comprising a tube sealing unit mounted on the second lower die for sealing the end of a tube captured in the first and second cavity portions so that upon pivotal adjustment of second lower die about the second pivot the seal unit will travel with the second lower die so as to remain in alignment with the second cavity portion.

4. The hydroforming apparatus of claim 1 further comprising said second upper die being attached to the upper platen by a bolt and slot connection by which loosening of the bolt will allow the second upper die to pivot about the first pivot.

5. The hydroforming apparatus of claim 1 further comprising said second lower die being attached to the lower platen by a bolt and slot connection by which loosening of the bolt will allow the second lower die to pivot about the second pivot.

6. The hydroforming apparatus of claim 1 further comprising said first and second upper dies each having an insert receiving pocket adjacent to the first pivot and having the upper die insert removably mounted therein; and the first and second lower dies each having an insert receiving pocket adjacent the second pivot and having the lower insert of the die insert removably mounted therein; and, a tube sealing unit mounted on the second lower die for sealing the end of a tube captured in the first and second cavity portions so that upon pivotal adjustment of second lower die about the second pivot the seal unit will travel with the second lower die so as to remain in alignment with the second cavity portion.

7. The hydroforming apparatus of claim 6 further comprising said second upper die being attached to the upper platen by a bolt and slot connection by which loosening of the bolt will allow the second upper die to pivot about the first pivot and said second lower die being attached to the lower platen by a bolt and slot connection by which loosening of the bolt will allow the second lower die to pivot about the second pivot.

8. A hydroforming apparatus for forming a length of tube, comprising:

a press having an upper platen and lower platen;

a first lower die and a second lower die, each having cavity portions, and a lower die insert removably mounted on the first lower die and the second lower die and having a cavity connecting the cavity portions of the first lower die and the second lower die;

a first upper die and a second upper die, each having cavity portions that overlie and cooperate with the cavity portions of the first lower die and second lower die, and an upper die insert removably mounted on the first upper die and the second upper die and having a cavity connecting the cavity portions of the first upper die and the second upper die;

a first pivot acting between the first upper die and the second upper die so that the second upper die can be pivotally adjusted on the upper platen relative to the first upper die when the upper die insert is removed for replacement by a replacement upper die insert, and a second pivot acting between the first lower die and the second lower die so that the second lower die can be pivotally adjusted on the lower platen relative to the first lower die when the lower die insert is removed for replacement by a replacement lower die insert.

9. The hydroforming apparatus of claim 8 further comprising a tube sealing unit mounted on the second lower die for sealing the end of a tube captured in the first and second cavity portions so that upon pivotal adjustment of the second lower die about the second pivot the seal unit will travel with the second lower die so as to remain in alignment with the second cavity portion.

10. The hydroforming apparatus of claim 8 further comprising said second upper die being attached to the upper platen by a bolt and slot connection by which loosening of the bolt will allow the second upper die to pivot about the first pivot and said second lower die being attached to the lower platen by a bolt and slot connection by which loosening of the bolt will allow the second lower die to pivot about the second pivot.

11. The hydroforming apparatus of claim 8 further comprising said second upper die being attached to the upper platen by a bolt and slot connection by which loosening of the bolt will allow the second upper die to pivot about the first pivot and said second lower die being attached to the lower platen by a bolt and slot connection by which loosening of the bolt will allow the second lower die to pivot about the second pivot;

and a tube sealing unit mounted on the second lower die for sealing the end of a tube captured in the first and second cavity portions so that upon pivotal adjustment of the second lower die about the second pivot the seal unit will travel with the second lower die so as to remain in alignment with the second cavity portion.

12. A hydroforming apparatus for forming a length of tube, comprising:

a press having an upper platen and lower platen;

a first lower die and a second lower die, each having cavity portions, and a lower die insert removably mounted within a pocket provided on the first lower die and a pocket provided on the second lower die, said upper die insert having a cavity connecting the cavity portions of the first lower die and the second lower die;

a first upper die and a second upper die, each having cavity portions that overlie and cooperate with the cavity portions of the first lower die and second lower die, and an upper die insert removably mounted within a pocket provided on the first upper die and the second upper die, said upper die having a cavity connecting the cavity portions of the first upper die and the second lower die;

a first pivot acting between the first upper die and the second upper die so that the second upper die can be pivotally adjusted on the upper platen relative to the first upper die when the upper die insert is removed from the pocket for replacement by a replacement upper die insert, and a second pivot acting between the first lower die and the second lower die so that the second lower die can be pivotally adjusted on the lower platen relative to the first lower die when the lower die insert is removed from the pocket for replacement by a replacement lower die insert, said replacement upper die insert having a cavity shaped to connect the cavity portions of the first upper die and second upper die at the pivotally adjusted position of the second upper die, and said replacement lower die insert having a cavity shaped to connect the cavity portions of the first lower die and the second lower die at the pivotally adjusted positions of the second lower die.

13. The hydroforming apparatus of claim 12 further comprising said second upper die being attached to the upper platen by a bolt and slot connection by which loosening of the bolt will allow the second upper die to pivot about the first pivot and said second lower die being attached to the lower platen by a bolt and slot connection by which loosening of the bolt will allow the second lower die to pivot about the second pivot.

14. The hydroforming apparatus of claim 12 further comprising a tube sealing unit mounted on the second lower die for sealing the end of a tube captured in the first and second cavity portions so that upon pivotal adjustment of the second lower die about the second pivot the seal unit will travel with the second lower die so as to remain in alignment with the second cavity portion.

15. The hydroforming apparatus of claim 14 further comprising said second upper die being attached to the upper platen by a bolt and slot connection by which loosening of the bolt will allow the second upper die to pivot about the first pivot and said second lower die being attached to the lower platen by a bolt and slot connection by which loosening of the bolt will allow the second lower die to pivot about the second pivot.

* * * * *